US008837093B2

(12) United States Patent
Panousis et al.

(10) Patent No.: US 8,837,093 B2
(45) Date of Patent: Sep. 16, 2014

(54) CIRCUIT ARRANGEMENT AND METHOD FOR INTERRUPTING A CURRENT FLOW IN A DC CURRENT PATH

(75) Inventors: Emmanouil Panousis, Baden (CH); Jadran Kostovic, Wettingen (CH); Lars Liljestrand, Västerås (CH); Markus Bujotzek, Zürich (CH); Per Skarby, Würenlos (CH)

(73) Assignee: ABB Technology AG, Zurich (CH)

( * ) Notice: Subject to any disclaimer, the term of this patent is extended or adjusted under 35 U.S.C. 154(b) by 35 days.

(21) Appl. No.: 13/471,117

(22) Filed: May 14, 2012

(65) Prior Publication Data

US 2013/0020881 A1 Jan. 24, 2013

(30) Foreign Application Priority Data

May 12, 2011 (EP) ..... 11165772

(51) Int. Cl.
*H01H 9/30* (2006.01)
*H01H 33/59* (2006.01)
*H01H 33/75* (2006.01)

(52) U.S. Cl.
CPC ..... *H01H 33/596* (2013.01); *H01H 33/75* (2013.01)
USPC ..... 361/13

(58) Field of Classification Search
USPC ..... 361/17, 13
See application file for complete search history.

(56) References Cited

U.S. PATENT DOCUMENTS

| | | | | |
|---|---|---|---|---|
| 3,737,724 | A | | 6/1973 | Salge et al. |
| 4,172,268 | A | * | 10/1979 | Yanabu et al. ..... 361/4 |
| 4,736,079 | A | * | 4/1988 | Soboul et al. ..... 218/57 |
| 4,805,062 | A | | 2/1989 | Shirouzu et al. |
| 5,214,557 | A | | 5/1993 | Hasegawa et al. |
| 5,452,170 | A | | 9/1995 | Ohde et al. |
| 5,668,691 | A | | 9/1997 | Ito et al. |
| 5,737,162 | A | | 4/1998 | Ito et al. |
| 5,793,586 | A | | 8/1998 | Rockot et al. |

FOREIGN PATENT DOCUMENTS

| | | | |
|---|---|---|---|
| DE | 20 39 065 | A1 | 2/1972 |
| DE | 37 34 989 | A1 | 4/1988 |
| DE | 43 04 863 | A1 | 8/1993 |
| EP | 0 411 663 | A2 | 2/1991 |
| EP | 0 740 320 | A2 | 10/1996 |
| EP | 0 758 137 | A1 | 2/1997 |

OTHER PUBLICATIONS

European Search Report for EP 11165772 dated Oct. 11, 2011.

* cited by examiner

*Primary Examiner* — Scott Bauer
(74) *Attorney, Agent, or Firm* — Buchanan Ingersoll & Rooney PC

(57) ABSTRACT

A DC current path for DC power transmission includes at least a first switching element and a second switching element connected in series. A resonance circuit is configured to be connectable in parallel to the series connection of the at least one first switching element and second switching element by means of a switch.

40 Claims, 4 Drawing Sheets

CIRCUIT ARRANGEMENT AND METHOD FOR INTERRUPTING A CURRENT FLOW IN A DC CURRENT PATH

RELATED APPLICATION

This application claims priority under 35 U.S.C. §119 to European Patent Application No. 11165772.2 filed in Europe on May 12, 2011, the entire content of which is hereby incorporated by reference in its entirety.

FIELD

The present disclosure relates to high voltage (HV) direct current (DC) transmission, and more particularly, to a circuit arrangement and a method for interrupting a current flow in a DC current path.

BACKGROUND INFORMATION

High voltage direct current transmission grids for transmitting energy on a large scale are regaining attention for various reasons. The re-advent of DC grids is strongly linked to a different concept of how to drive power into the DC grid. Future DC grids may be controlled by a voltage controlled source, also known as voltage source converters (VSC). In such grids, a fault current may rise very fast in case of a short circuit and as a result may burden the system reliability.

In the event of a short circuit in a known AC grid, an interrupt concept may benefit from the alternating properties of the AC in the grid. When opening an associated circuit breaker in an AC current path, an electric arc may electrically connect such circuit breaker electrodes and may continue to allow an electric arc current to cross the circuit breaker. However, due to the nature of the AC driving source, such ongoing electric arc current in the AC current path may oscillate, too, and inherently may show current zero crossings. A zero crossing in current is desired for extinguishing the electric arc and for stopping the current flow across the circuit breaker completely.

In DC grids, however, no such current zero crossing occurs as a consequence of the driving source, but a current zero in the DC current path is desired to be generated by other means when or after the circuit breaker is brought to its open state. In one approach, a current zero is caused by injecting an oscillating growing counter-current into the DC current path. Such oscillating counter-current may at one point in time compensate for the electric arc current and may finally cause at least a temporary current zero in the DC current path which in turn may be used for extinguishing the electric arc. A means for evoking an oscillating counter-current may be a resonance circuit arranged in parallel to the circuit breaker. Such circuit breaker is more generally denoted in the following text as switching element. However, after connecting the resonance circuit in parallel to the switching element, a certain time must be lapsed before the oscillating counter-current reaches a magnitude sufficient to compensate for the electric arc current across the switching element: this will be hereinafter referred to as time to Current Zero (tCZ).

DE 2 039 065 refers to a circuit breaker arrangement in which the current is first commutated from the main path into an ohmic resistance path prior to being commutated into an absorber path. For building such ohmic resistance path affecting the main path, the circuit breaker is split into at least two circuit breakers, one of which may be switched to shunt the ohmic resistance which upon switching explodes in view of the high currents applied. This event, in turn, makes the current commutate into the absorber path.

SUMMARY

An exemplary embodiment of the present disclosure provides a circuit arrangement for interrupting a current flow in a DC current path. The exemplary circuit arrangement includes at least one first switching element and at least one second switching element connected in series in the DC current path. In addition, the exemplary circuit arrangement includes a resonance circuit being connected in parallel or being configured to be connectable by means of a switch in parallel to the series connection of the at least one first switching element and at least one second switching element. The first switching element includes one of an oil circuit breaker, a minimum oil circuit breaker, a strongly blow electric arc, a splitter blade, and a FCS commutation switch.

An exemplary embodiment of the present disclosure provides a circuit arrangement for interrupting a current flow in a DC current path. The exemplary circuit arrangement includes at least one first switching element in the DC current path, and a resonance circuit configured to be connectable in parallel to the at least one first switching element by means of a switch. The first switching element has an electric arc voltage over electric arc current characteristic including at least one electric arc voltage of sufficient magnitude for generating a counter-current in the resonance circuit greater or equal to an electric arc current in the DC current path upon closing the switch.

An exemplary embodiment of the present disclosure provides a method for interrupting a current flow in a DC current path. The exemplary method includes detecting an interrupt scenario for the DC current path including at least one first switching element and at least one second switching element connected in series. The first switching element includes one of an oil circuit breaker, a minimum oil circuit breaker, a strongly blow electric arc, a splitter blade and an FCS commutation switch. The exemplary method also includes effecting an open state of the at least one first switching element and at the least one second switching element, and connecting a resonance circuit in parallel to the series connection of the at one least first switching element and the at least one second switching element for generating a counter-current in the resonance circuit.

An exemplary embodiment of the present disclosure provides a method for interrupting a current flow in a DC current path. The exemplary method includes detecting an interrupt scenario for the DC current path including at least one first switching element, and effecting an open state of the at least one first switching element. In addition, the exemplary method includes connecting a resonance circuit in parallel to the at least one first switching element in response to an electric arc voltage at the first switching element being of sufficient magnitude for generating a counter-current in the resonance circuit greater or equal to an electric arc current in the DC current path upon activating the switch.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
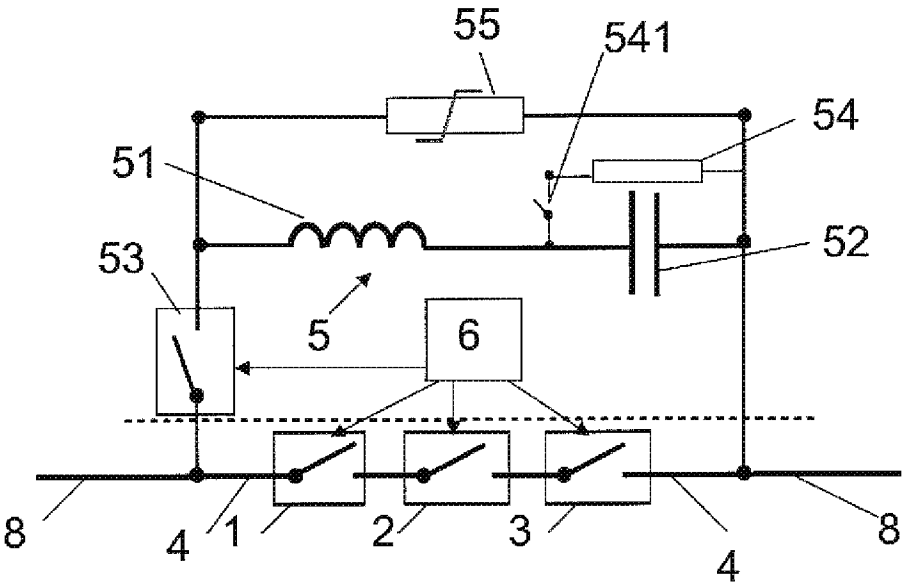
FIG. 1 is a block circuit diagram of a circuit arrangement according to an exemplary embodiment of the present disclosure.

Exemplary embodiments of the present disclosure provide a circuit arrangement and method which reduce the time to generate a current zero in a DC current path.

According to an exemplary embodiment of the present disclosure, a circuit arrangement is provided for interrupting a current flow in a DC current path. The circuit arrangement includes at least a first switching element and a second switching element connected in series in the DC current path. A resonance circuit is connected or is configured to be connectable in parallel to the series connection of the at least first switching element and second switching element by means of a switch.

According to an exemplary embodiment of the present disclosure representing a method, an interrupt scenario is detected for the DC current path including at least a first switching element and a second switching element connected in series. An open state of the at least first switching element and second switching element is effected in response to an interrupt scenario detected. A resonance circuit is connected in parallel to the series connection of the at least first switching element and second switching element for generating a counter-current in the resonance circuit.

The time to Current Zero tCZ—that is, the time between closing the switch for activating the resonance circuit and achieving a current zero in the DC current path—is reduced by means of providing at least two switching elements in the DC current path, for example, at least one first switching element and at least one second switching element connected in series, and may be reduced to equal to or less than 10 ms. In case of a passive switching concept in which the resonance circuit is permanently connected to the series connection of the first and the second switching element, the time to Current Zero may be defined as time between a start of counter current oscillations and achieving a current zero in the DC current path. In an accordance with an exemplary embodiment, the first switching element may be designed and optimized with respect to good commutation capabilities generating a fast rising oscillation, while the second switching element may be designed and optimized with respect to good thermal and dielectric separation capabilities.

The time to Current Zero tCZ may be related to a voltage drop at the electric arc and to a dimensioning of a capacitance present in the resonance circuit. While a high capacitance value is advantageous in view of short oscillation rise times, associated capacitors are cost intensive. On the other hand, in case that the first switching element may supply high voltage drops in the event of an electric arc between its contacts, the rise time may be reduced significantly while at the same time the capacitance can be dimensioned reasonably.

It is noted that the term "resonance circuit" in the present disclosure is understood as an LC circuit including an inductance and a capacitance, for example, connected in series, wherein the inductance may be embodied as a separate element or may be represented by an inductance of the line of the resonance circuit. The term "resonance circuit" therefore does not need to represent a closed loop but may be a circuit which in the event of being switched into a closed loop shows a resonance characteristic.

According to an exemplary embodiment of the present disclosure, the rise time is reduced by an appropriate design of the capacitance and the first switching element. In this regard, the circuit arrangement can be designed such that upon connecting the resonance circuit in parallel to the at least first switching element a counter-current in the resonance circuit may be generated that immediately rises to a level equal or greater than the electric arc current passing the open state switching element without having to run through multiple oscillations before reaching such a level. "In parallel to the at least first switching element" shall include in parallel to a series connection of more than one switching element in case of more than one switching element being provided.

According to this exemplary embodiment of the present disclosure, a circuit arrangement is provided for interrupting a current flow in a DC current path, including at least one first switching element in the DC current path and a resonance circuit adapted to be connectable in parallel to the at least one first switching element by means of a switch. The first switching element has an electric arc voltage over electric arc current characteristic including at least one electric arc voltage value of sufficient magnitude for generating a counter-current in the resonance circuit greater or equal to an electric arc current in the DC current path upon closing the switch. The counter-current may typically reach the electric arc current in asymptotic manner and thus create a current zero in the DC current path.

According to an exemplary embodiment of the present invention representing a method, an interrupt scenario is detected for the DC current path including at least one first switching element. An open state of the at least first switching element is effected in response to the detection of the interrupt scenario. A resonance circuit is connected in parallel to the at least one first switching element in response to an electric arc voltage at the first switching element being of sufficient magnitude to generate a counter-current in the resonance circuit equal or greater to an electric arc current in the DC current path upon activating the switch.

Additional features of the present disclosure are described in more detail below with reference to exemplary embodiments illustrated in the drawings.

The described embodiments similarly pertain to the circuit arrangement and to the method of both the first and the second aspect. Synergetic effects may arise from different combinations of the embodiments, although they might not be described in detail.

Furthermore, it shall be noted that all embodiments of the present disclosure concerning a method might be carried out in the order of the steps as described or in any other order of the steps. The scope of the present disclosure shall include any order of steps irrespective of the order listed in the claims.

Circuit breakers are considered as key components of future HVDC grids. Especially in networks based on VSC technology, the requirements for circuit breakers regarding interruption time are very tough compared to other existing DC and AC technologies. It may be desired to achieve interruption times of less than 10 ms.

A HVDC circuit breaker may be challenged by various requirements such as:

A current zero (CZ) crossing may be generated in the DC current path in the event of an electric arc current passing an open state circuit breaker. The faster such current zero crossing may be achieved the better.

An electric arc at the circuit breaker may be extinguished once a current zero crossing is achieved. Good thermal interruption properties of a circuit breaker may be required with regard to clearing the electric arc.

Once the electric arc is extinguished, it is preferred that the circuit breaker withstands a voltage recovery at its contacts and as such withstands a reoccurrence or reestablishment of a new electric arc.

Optimizing a circuit breaker according to any one of the above requirements may have a counterproductive effect on the remaining requirements. Hence, according to an exemplary embodiment of the present disclosure, it is suggested to provide at least two circuit breakers, or more generally, at least two switching elements. This results in a modular layout in which a first switching element may be designed for optimizing switching properties. The first switching element in this respect may be considered as a commutating switch. Such commutating switch may provide a high electric arc voltage and/or a highly negative differential arc resistance (du/di). The second switching element may be designed to provide exemplary properties on any non-commutating aspects, such as good thermal interruption properties for extinguishing the electric arc, and/or good dielectric properties for withstanding voltage recovery. The first switching element may be one of an oil circuit breaker, a minimum oil circuit breaker, a strongly blow electric arc, and a splitter blade, for example. The second switching element may be one of a gas interrupter, such as a sulfur hexafluoride based interrupter, e.g. an $SF_6$ interrupter, and a vacuum interrupter, for example.

The strongly blow electric arc circuit breaker may refer to a circuit breaker in which an arc burning inside a nozzle of the circuit breaker is blown under an imposed supersonic gas flow. The splitter blade circuit breaker may refer to a circuit breaker using splitter blades for increasing the arc voltage. In another alternative, the first switching element may also be embodied as an FCS commutation. An FCS commutation switch refers to a fast commutation switch.

In an exemplary embodiment, there are provided three switching elements, wherein the second switching element is designed with respect to a good thermal interruption capability, and as such may, for example, be implemented as a vacuum interrupter. The third switching element may be designed with respect to a good dielectric isolation capability for withstanding recovery voltages, and as such may, for example, be implemented as a gas-blast circuit breaker, e.g. as a sulfur hexafluoride based interrupter, such as an $SF_6$ interrupter.

The block circuit diagram of FIG. 1 illustrates a circuit arrangement according an exemplary embodiment of the present disclosure including a DC current path 4. The DC current path 4 may directly or indirectly via a DC grid 8 be connected to a voltage source converter with a service supply voltage of 320 kV, for example. The DC current path 4 in the present embodiments denotes a section of the DC grid 8 including the one or more switching elements 1, 2, 3, and which section specifically may be connectable to the resonance circuit 5. The DC grid 8 and consequently the DC current path 4 may include any of a transmission path for DC current, and may be a transmission line, for example. The functional term "for DC current" shall mean that in a regular operation mode DC current is transmitted. However, in a fault handling mode current with alternating polarity may, nevertheless, be transmitted in the DC grid 8 and DC current path 4, if needed or if it may occur. The DC grid 8 including the DC current path 4 may be embodied as a transmission path for transmitting currents, which are also denoted as nominal currents or rated currents or operating currents, for example as operating currents of 1.5 kA, for example, between 1.5 kA and 2.5 kA.

The DC current path 4 of FIG. 1 includes a first switching element 1, a second switching element 2, and a third switching element 3 connected in series. The first switching element 1 may be a commutation switch, the second switching element 2 may be a vacuum interrupter, and the third switching element 3 may be an $SF_6$ interrupter, for example. The entirety of switching elements 1, 2, 3 arranged in the DC current path 4 is designed for interrupting a current flow in the DC current path 4 in the event of a failure, such as a short circuit. By quickly interrupting a current flow in the DC current path in such a scenario circuit elements, loads, etc. may be protected.

A resonance circuit 5 of the circuit arrangement according to FIG. 1 may include a capacitance 52 arranged in series with an inductance 51. The capacitance 52 may for example have a value between 1 μF and 15 μF, for example, less than 100 μF. The inductance 51 may be a separate circuit element or may be an inductance representing the wiring of the resonance circuit 5. The inductance 51 may have a value between roughly 10 μH and 2 mH, for example. A surge arrester 55 may be connected in parallel to the resonant branch 5 or in parallel to the capacitance 52 for dissipating any residual energy.

The resonance circuit 5 can be connected in parallel to the series connection of the switching elements 1, 2, 3 by means of a switch 53. The switch 53 may be a switch that can controllably be switched between an ON and an OFF state and vice versa, or that can controllably be switched from an OFF to an ON state and revert to the OFF state autonomously, such as a spark gap may do, for example. In a service condition of the DC current path 4, the switch 53 is may be in an open state and the switching elements 1, 2, 3 are in a closed state. As a result, an operating current flows in the DC current path 4 and the resonance circuit 5 is interrupted by the open state switch 53.

By means of measuring a current in the DC current path 4 or in the DC grid 8 by means of measuring a voltage drop across any element, for example by means of a fault current limiting inductance in the DC grid 8, a malfunctioning may be detected. In accordance with an exemplary embodiment, a short circuit somewhere in the DC grid 8 may be detected by means of current and/or voltage measurement exceeding a threshold, which may be considered as an indicator for a failure mode. In other words, in case of a short circuited DC grid 8, the current in the DC current path 4 may rise from the operating current level to a fault current level with a rate of such rising being defined by a nominal voltage or rated voltage or operating voltage U and an inductance value L of an inductance in the DC grid 8. When such values or measurements indicate that it is necessary to interrupt the current flow in order to prevent damages in the circuit arrangement or in the DC grid 8, respectively, a control unit 6 may activate the three switching elements 1, 2, 3 into an open state each, and may do so in simultaneous fashion. In such state, an electric arc may occur and continue to allow an electric arc current to flow in the DC current path 4.

In accordance with an exemplary embodiment, the switch 53 may be closed by the control unit 6 more or less simultaneously with the opening of the switching elements 1, 2, 3. A switch in this context may be a device to be controllably closed and to provide an electrical connection between its contacts. Such switch may either controllably or inevitably be reopened again. In one embodiment, the switch 53 may be a known switch withstanding the expected currents. In another embodiment, the switch 53 may be a spark gap which may actively be triggered into a closed state by triggering the spark gap between its contacts, and which may reopen automatically after the spark is extinguished.

Figure 2:
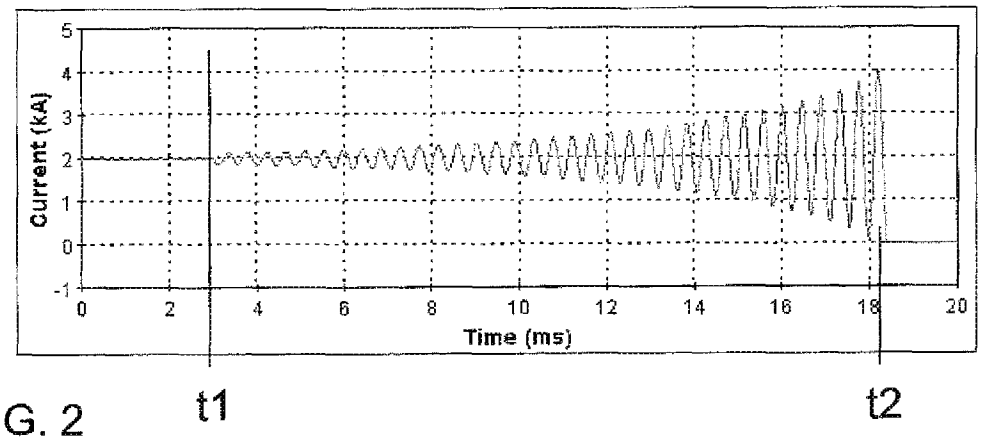
FIG. 2 is a chart illustrating a sample current characteristic over time in a DC current path having a method for interrupting a nominal or rated or operating current flow in the DC current path applied according to an exemplary embodiment of the present disclosure.

By closing the switch 53, the resonance circuit 5 forms a closed loop over the electric arc. By closing the loop, a counter-current in the resonance circuit 5 may be evoked due to a voltage change at the capacitance 52 which superimposes the electric arc current in the DC current path 4 and evokes at least temporarily a current zero in the DC current path 4. A sample current signal in the DC current path 4 is illustrated in FIG. 2. Prior to time t1, the current in the DC current path 4 is equal to the operating current of e.g. ~2 kA. At time t1 the resonance circuit 5 is connected in parallel to the series of the switching elements 1, 2, 3. Up to this stage, the capacitance 52 of the resonance circuit 5 is not charged. An oscillating counter-current is generated which needs a considerable time to grow in magnitude. A current zero crossing may, for example, be reached at t2=18 ms which may be sufficient for interrupting a regular operating current. Such current zero crossing in turn is a condition for completely breaking the current in the DC current path 4 by means of the second switching element 2 which may extinguish the electric arc.

In accordance with another exemplary embodiment, the switch 53 is closed by the control unit 6 at time tx with tx>t1. In the meantime, the electric arc voltage has risen and as a result an increased electric arc voltage now evokes a counter-current flow of a larger initial magnitude. Hence, fewer oscillations are needed for achieving a current zero crossing in the DC current path 4 and consequently the time to generate a current zero crossing may be reduced. The current oscillation will grow from zero in the resonance circuit, and from an electric arc current level in the DC current path 4.

In the above embodiments, three switching elements 1, 2, 3 are arranged in combination with a semi-active resonance circuit 5 in which a switch 53, also denoted as a closing device 53, is operable to connect the resonance circuit 5 to a series connection of the switching elements 1, 2, 3. There may be less than three switching elements 1, 2, 3 such as two switching elements 1, 2 only. For example, switching elements 2 and 3 may be combined.

In accordance with an exemplary embodiment, the resonance circuit includes a resistor 54 or, alternatively, a surge arrester 55. Such resistor 54 may be used for discharging the capacitance 52 immediately after successful interruption to avoid dielectric stress and to have the capacitance 52 reset for a subsequent operation. An exemplary means for connecting the resistor 54 in parallel to the capacitance 52 is a switch 541 (see FIG. 1), which may also be controlled by the control unit 6. Alternatively, the resistor 54 is dimensioned in such a way that it can be placed permanently in parallel to the capacitance 52. In this case, the corresponding resistance has to be low enough to ensure a discharge between two open operations, but high enough not to disturb the operation during the interruption process. A value in the range of kOhms may be an exemplary resistance value.

In accordance with another exemplary embodiment, the circuit arrangement may be designed and operated in a different way. The first switching element 1 may now have an electric arc voltage over electric arc current characteristic including at least one electric arc voltage value of sufficient magnitude for generating a counter-current in the resonance circuit greater or equal to the electric arc current in the DC current path. The counter-current may asymptotically reach the electric arc current and thus create a current zero in the DC current path. A sample electric arc voltage may be more than 20 kV, for example, more than 30 kV for a typical fault current value in a range between 10 kA and 20 kA.

Whenever the switch 53 is closed, the then present electric arc voltage across the first switching element 1 is responsible for driving the counter-current into the resonance circuit 5. In other words, the electric arc current of the DC current path 4 is commutated into the resonance circuit 5 according to Kirchhoff's current law. Upon closing the switch 53 the counter-current I in the resonance circuit 5 follows $$I=C*dU/dt$$

with U being the electric arc voltage between the contacts of the first switching element 1. On the other hand, such counter-current I may be high enough to counterbalance the electric arc current in the DC current path 4. This is why the first switching element 1 is chosen such that it provides an electric arc voltage over electric arc current characteristic in which for a given capacitance value C in the resonance circuit 5 there is an associated electric arc voltage U with a corresponding electric arc current I that fulfils the above equation. This supports implementing a circuit arrangement, in which immediately upon activating the switch 53 the counter-current in the resonance circuit 5 rises to a level at least sufficient to compensate the electric arc current in order to generate a current zero in the DC current path 4. In such embodiment, it is advantageous to keep the switch 53 open as long as the sufficient electric arc voltage is not achieved yet.

Figure 4:
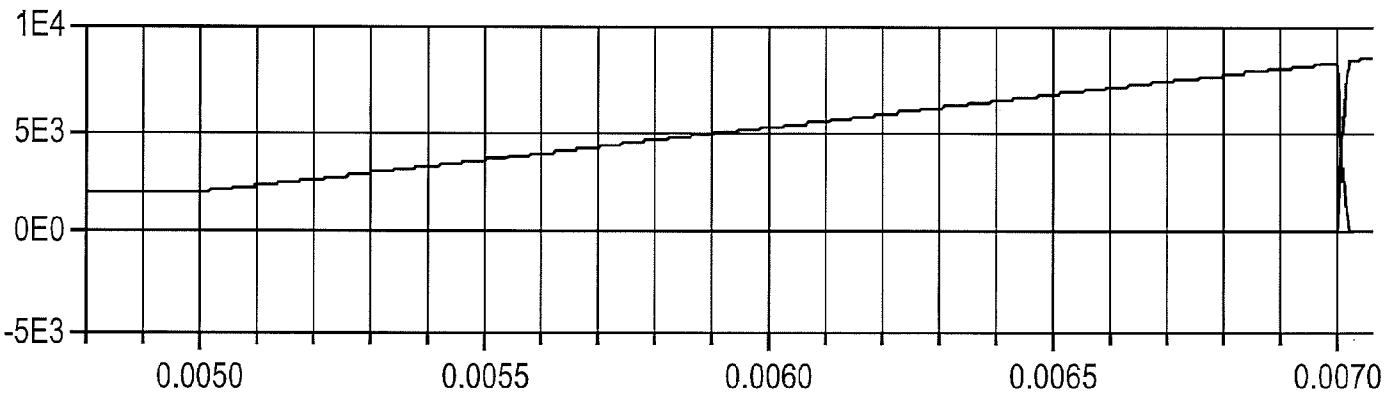
FIG. 4 and FIG. 5 are each a chart illustrating sample current and/or voltage characteristics over time when having applied a method for interrupting a current flow in the DC current path applied according to an exemplary embodiment of the present disclosure.

A sample current regime is illustrated in FIG. 4. The upper curve represents an electric arc current in the DC current path 4 upon a failure, and as such shows a rising electric arc current. The lower curve shows the associated counter-current in the resonance circuit 5. Upon switching the resonance circuit 5 in parallel to the at least first switching element at t=0.007 (a.u.), the entire current in the DC current path 4 is commutated into the resonance circuit 5. This is why the current in the DC current path 4 drops to current zero which enables the electric arc to be extinguished.

Hence, a monitoring unit—which may be implemented in the control unit 6—may monitor the electric arc voltage at the first switching element 1 and whenever a sufficient electric arc voltage is achieved, for example, when the electric arc voltage exceeds a given threshold, may close the switch 53. In accordance with an exemplary embodiment, an electric arc voltage may be predictable such that after a certain period in time after having opened the at least first switching element 1 the switch 53 can safely be closed under the assumption that at that point in time the electric arc voltage will have reached a sufficient magnitude even without monitoring the electric arc voltage.

In such embodiment, generating a current zero crossing in the DC current path is initiated by switching in the capacitance 52 in the resonance circuit 5 only when the electric arc voltage across the commutation switch, e.g., the first switching element 1, is sufficiently high. If the electric arc voltage is high enough and the capacitance 52 is sufficiently large an "in-rush" current, e.g., the counter-current, into the capacitance 52 of the resonance circuit 5 is large enough to generate a current zero crossing in the DC current path 4. In other words, immediately after switching-in the resonance circuit 5 the capacitance 52 represents a short-circuit which is driven by the electric arc voltage. If the resonance circuit 5 can take all the current from the DC current path 4, a current zero will be generated in the DC current path 4. This occurs immediately after activating the switch 53 and no oscillations in current are required for achieving the required electric arc current level. As indicated above, the switching-in is achieved by means of a fast closing device such as a spark gap which is triggered by the control unit 6 or is self-triggered. Triggering at the right instant can either be done by delaying closing of the switch 53 after the first switching element 1 is tripped, for example, knowing when the electric arc voltage is sufficiently high. Alternatively, the electric arc voltage is measured and a feed back control loop controls the switch 53 subject to the measured electric arc voltage. The latter embodiment may be more robust since the first switching element 1 may exhibit a dependence of the electric arc voltage depending on the fault current evolution. Once the switch 53 is activated, the electric arc current is commutated into the capacitance 52 in the resonance circuit 5. If this in-rush current into the capacitance 52 is sufficiently high, this is "seen" by the DC current path 4 as a current zero hence allowing a thermal interruption of the electric arc to take place. By such concept, fast interruption times can be achieved, for example, in the range of equal to or less than 10 ms.

For generating sufficient electric arc voltage to "drive" sufficient counter-current into the capacitance 52—which is a finite capacitance 52 and may be less than 100 μF, for example—the first switching element 1 may be embodied as a commutation switch or any other breaker with high electric arc voltages. For example, minimum-oil circuit breakers, strongly blown electric arc circuit breakers such as air-blast, $SF_6$ puffer, or $SF_6$ self-blast circuit breakers, series connections of circuit breakers, a commutation switch, in particular fast commutation switch FCS, or splitter blades splitting the switching arc in a series of several arcs in order to increase the total arc voltage up to the driving voltage such as used in low voltage technology are exemplarily proposed to be used for this purpose.

Since the current to be interrupted may have a rather high frequency (in the range of kHz) and a correspondingly high current derivative, such as several hundred A/μs, it may be advantageous to have a separate interrupter, for example, a vacuum interrupter for interrupting the current thermally. The subsequent recovery voltage is then shared by all, now opened switching elements 1, 2, 3. There may be a need for a breaker which is able to withstand a full recovery voltage without re-igniting or re-striking an electric arc. This can be achieved by a designated interrupter, presently denoted as third switching element 3, which has a high dielectric withstand capability. Such interrupter may, for example, be implemented as an $SF_6$ interrupter with gas-blown contacts. When the recovery voltage derivative is rather low a decoupling of thermal and dielectric regimes should be possible to be handled with small grading capacitances or even by relying only on the natural stray capacitance of the open breakers.

Figure 5:
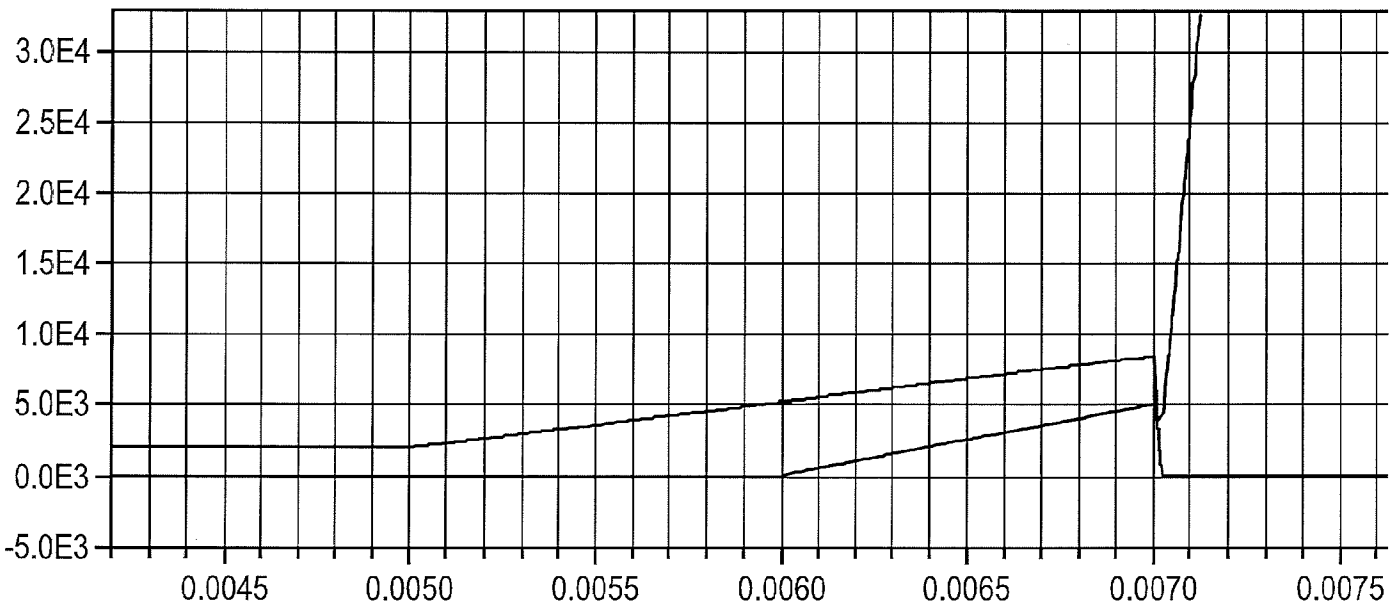

In FIG. 5, the upper curve shows the current in the DC current path 4 to be interrupted and the lower curve the associated electric arc voltage over time, e.g., the voltage of the first switching element 1. Soon after the current drop in the DC current path 4 a voltage recovery is apparent. A current derivative dI/dt shortly before current zero may, for example, be about 200 A/μs. A steepness of the recovery voltage after interruption is given by the ratio I/C of the magnitude of the electric arc current and the capacitance C of the resonance circuit 5. In a simulated example the voltage steepness is found to be about 0.3 kV/μs after current zero. Present $SF_6$ interrupters can handle much higher voltage derivatives exceeding 10 kV/μs.

Figure 3:
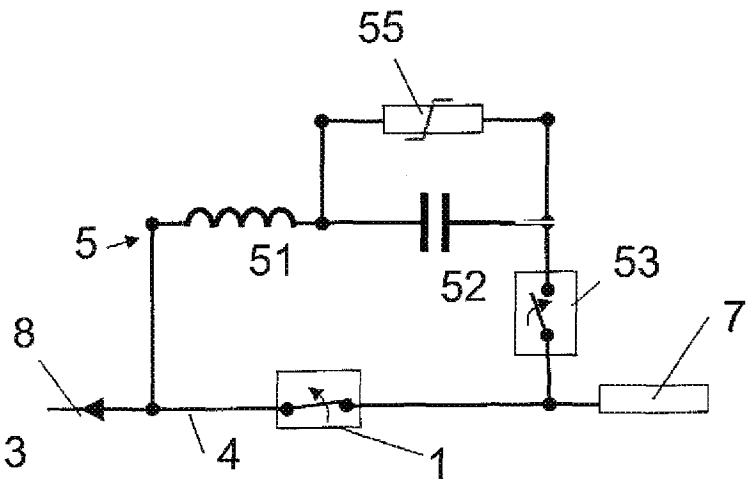
FIG. 3 is a block circuit diagram of a circuit arrangement according to an exemplary embodiment of the present disclosure.

The concept of evoking a "one shot" counter-current which may compensate the electric arc current level within the first rise may not necessarily be embodied in combination with multiple switching elements, such as shown in FIG. 1. Instead, this concept may in a different embodiment be implemented with only a single switching element, e.g., the first switching element 1. A corresponding block diagram is shown in FIG. 3. Additionally, the block diagram of FIG. 3 illustrates an inductance 7 arranged in the DC grid 8 for limiting currents, and in particular for limiting a slope of a rising fault current. In the event of a short circuit in the DC grid 8 the current in the DC grid 8 and hence in the DC current path 4 may rise from the operating current level to a higher fault current level. However, the inductance 7 may only modify the rise time of a fault current but not its magnitude. For such reason, the fault current in the DC current path 4 may be wanted to be interrupted by the switching element 1.

In summary, the various aspects and embodiments of the present disclosure offer—in view of fast mechanical DC circuit breakers presently not being available—a circuit breaker arrangement with a modular approach for separating the challenges for a DC breaker into several dedicated switching elements, and/or a concept for using a switch and a quasi-static electric arc voltage for allowing an excitation of a resonance circuit faster than in previous concepts. There is no permanent DC charging of a capacitance of the resonance circuit required, hence there is no charging device needed. The capacitance is not pre-charged, for example, the capacitance is only charged during electric arc current interruption and may subsequently be discharged. This makes an auto-reclose requirement (open-close-open) easier to be fulfilled than if the capacitance would be pre-charged with the same or an opposite polarity.

A temporary overvoltage during commutation of the current into the capacitance can be set much higher than when using a permanent DC-pre-charge voltage. Hence, size and costs of the capacitance can be reduced considerably. In addition, an optional discharging of the capacitor with a resistor prevents large in-rush current during the subsequent close operation.

Figure 6:
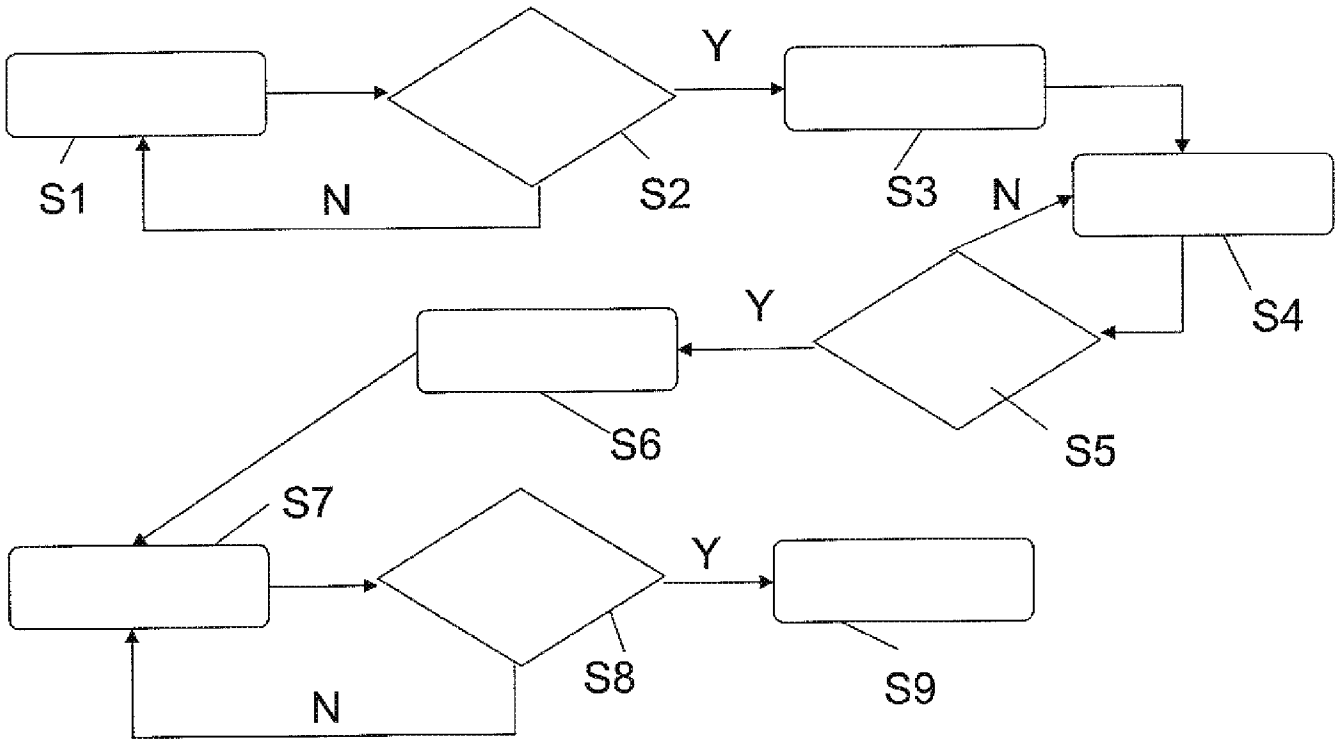
FIG. 6 is a flow diagram illustrating a method for interrupting a current flow in a DC current path according to an exemplary embodiment of the present disclosure.

FIG. 6 illustrates a flow chart representing a method for interrupting a current in a DC current path according to an embodiment of the present disclosure. In the following, the term "step" means "method element" and does not require or imply an order or sequence of steps or method elements to be performed according to the numbering of the step or method element. In step S1, the DC grid is monitored for a failure event such as a short circuit, for example, by monitoring the current in the DC grid. In step S2, it is determined if such current exceeds a threshold which may be taken as an indicator for a failure event. In case the current does not reach or exceed the threshold (N), the DC grid is continued to be monitored. In case the current exceeds the threshold (Y) in step S3, the one or more switching elements are operated into an open state. As a result, an electric arc current is flowing in the DC current path, and an electric arc voltage may drop at the first switching element. In step S4, the electric arc voltage may be monitored, and in step S5, it is determined whether the present electric arc voltage exceeds a threshold. In case the electric arc voltage does not reach or exceed the threshold (N) the electric arc voltage is continued to be monitored. In case the electric arc voltage exceeds the threshold (Y) the switch for activating the resonance circuit is activated in step S6 in order to connect the resonance circuit in parallel to the one or more switching elements. Instead of monitoring the electric arc voltage in step S4 and the subsequent determination in step S5, a timer may be set and the switch can be closed after a time-out of the timer.

The closing of the switch for activating the resonance circuit may induce either an oscillating counter-current in the resonance circuit, or a counter-current of immediate sufficient magnitude. In step S7, the counter-current and/or the electric arc current is monitored. In step S8, it is determined whether the counter-current or the electric arc current is of sufficient magnitude to fully compensate the electric arc current, or already or not yet shows a zero crossing respectively. If this is not the case (N), the monitoring step S7 is continued. If this is the case (Y), the electric arc across the switching element 1 is extinguished by known means in step S9.

All appended claims in their entirety and inclusive all their claim dependencies are herewith literally incorporated into the description by reference.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A circuit arrangement for interrupting a current flow in a DC current path, comprising:

at least one first switching element and at least one second switching element connected in series in the DC current path; and a resonance circuit being connected in parallel or being configured to be connectable by means of a switch in parallel to the series connection of the at least one first switching element and at least one second switching element, wherein the first switching element includes one of an oil circuit breaker, a minimum oil circuit breaker, a strongly blow electric arc, a splitter blade, and a FCS commutation switch, and wherein the first switching element comprises a circuit breaker with a negative slope in at least a portion of its electric arc voltage over electric arc current characteristic.

2. The circuit arrangement according to claim 1, wherein the first switching element has an electric arc voltage over electric arc current characteristic including electric arc voltage values exceeding 20 kV.

3. The circuit arrangement according to claim 1, wherein a time to Current Zero (tCZ) defined as a time between closing the switch for activating the resonance circuit and achieving a current zero in the DC current path is equal to or less than 10 ms.

4. The circuit arrangement according to claim 1, wherein the second switching element comprises a high thermal interrupting capability device.

5. The circuit arrangement according to claim 1, comprising:

a third switching element connected in series with the first switching element and the second switching element in the DC current path.

6. The circuit arrangement according to claim 5, wherein the third switching element comprises a high dielectric withstand device.

7. The circuit arrangement according to claim 1, wherein the resonance circuit comprises a capacitance and an inductance connected in series, wherein the capacitance has a capacitance value of less than 100 μF.

8. The circuit arrangement according to claim 7, comprising a resistor or a surge arrester configured to be connectable in parallel to the capacitance for discharging the capacitance.

9. The circuit arrangement according to claim 1, comprising a control unit for controlling one or more of the switching elements and the switch.

10. The circuit arrangement according to claim 9, wherein the control unit is configured to simultaneously effect an open state of all switching elements available in response to an interrupt scenario detected for the DC current path.

11. The circuit arrangement according to claim 9, comprising a monitoring unit for monitoring an electric arc voltage at the first switching element, wherein the control unit is configured to connect the resonance circuit in parallel to the at least one first switching element subject to the electric arc voltage monitored by the monitoring unit.

12. The circuit arrangement according to claim 9, wherein the control unit is adapted to connect the resonance circuit in parallel to the at least one first switching element at a defined period after the at least first switching element is effected to the open state.

13. The circuit arrangement according to claim 2, wherein the electric arc voltage values exceed 30 kV.

14. The circuit arrangement according to claim 4, wherein the second switching element comprises a vacuum interrupter.

15. The circuit arrangement according to claim 6, wherein the third switching element comprises a gas-blast circuit breaker including one of a compressed gas device and a sulphur hexafluoride based interrupter.

16. The circuit arrangement according to claim 10, comprising a monitoring unit for monitoring an electric arc voltage at the first switching element, wherein the control unit is configured to connect the resonance circuit in parallel to the at least one first switching element subject to the electric arc voltage monitored by the monitoring unit.

17. The circuit arrangement according to claim 10, wherein the control unit is adapted to connect the resonance circuit in parallel to the at least one first switching element at a defined period after the at least first switching element is effected to the open state.

18. A circuit arrangement for interrupting a current flow in a DC current path, comprising:

at least one first switching element in the DC current path; and a resonance circuit configured to be connectable in parallel to the at least one first switching element by means of a switch, wherein the first switching element has an electric arc voltage over electric arc current characteristic including at least one electric arc voltage of sufficient magnitude for generating a counter-current in the resonance circuit greater or equal to an electric arc current in the DC current path upon closing the switch, and wherein the first switching element comprises a circuit breaker with a negative slope in at least a portion of its electric arc voltage over electric arc current characteristic.

19. The circuit arrangement according to claim 18, wherein the first switching element has an electric arc voltage over electric arc current characteristic including electric arc voltage values exceeding 20 kV.

20. The circuit arrangement according to claim 18, wherein a time to Current Zero (tCZ) defined as a time between closing the switch for activating the resonance circuit and achieving a current zero in the DC current path is equal to or less than 10 ms.

21. The circuit arrangement according to claim 18, wherein the resonance circuit comprises a capacitance and an inductance connected in series, wherein the capacitance has a capacitance value of less than 100 μF.

22. The circuit arrangement according to claim 21, comprising a resistor or a surge arrester configured to be connectable in parallel to the capacitance for discharging the capacitance.

23. The circuit arrangement according to claim 18, comprising a control unit for controlling the at least one first switching elements and the switch.

24. The circuit arrangement according to claim 23, wherein the control unit is configured to simultaneously effect an open state of each switching element available in response to an interrupt scenario detected for the DC current path.

25. The circuit arrangement according to claim 23, comprising a monitoring unit for monitoring an electric arc voltage at the first switching element, wherein the control unit is configured to connect the resonance circuit in parallel to the at least one first switching element subject to the electric arc voltage monitored by the monitoring unit.

26. The circuit arrangement according to claim 23, wherein the control unit is adapted to connect the resonance circuit in parallel to the at least one first switching element at a defined period after the at least first switching element is effected to the open state.

27. The circuit arrangement according to claim 24, comprising a monitoring unit for monitoring an electric arc voltage at the first switching element, wherein the control unit is configured to connect the resonance circuit in parallel to the at least one first switching element subject to the electric arc voltage monitored by the monitoring unit.

28. The circuit arrangement according to claim 24, wherein the control unit is adapted to connect the resonance circuit in parallel to the at least one first switching element at a defined period after the at least first switching element is effected to the open state.

29. A method for interrupting a current flow in a DC current path, comprising:

detecting an interrupt scenario for the DC current path including at least one first switching element and at least one second switching element connected in series, the first switching element including one of an oil circuit breaker, a minimum oil circuit breaker, a strongly blow electric arc, a splitter blade and an FCS commutation switch;

effecting an open state of the at least one first switching element and at the least one second switching element; and connecting a resonance circuit in parallel to the series connection of the at one least first switching element and the at least one second switching element for generating a counter-current in the resonance circuit, wherein the first switching element comprises a circuit breaker with a negative slope in at least a portion of its electric arc voltage over electric arc current characteristic.

30. The method according to claim 29, comprising:

monitoring at least one of a current in a DC grid including the DC current path and a voltage across an inductance arranged in the DC grid for detecting the interrupt scenario.

31. The method according to claim 29, wherein the capacitance is in an uncharged state prior to connecting the resonance circuit in parallel to the series connection of the at least first switching element.

32. The method according to claim 29, wherein the resonance circuit is connected in parallel to the switching element after the open state of the at least first switching element is effected.

33. The method according to claim 29, wherein the counter-current reaches a level exceeding or equal to the electric arc current within a first rise in the counter-current signal.

34. The method according to claim 29, wherein the counter-current is an oscillating counter-current reaching a level exceeding or equal to the electric arc current only after some oscillations.

35. A method for interrupting a current flow in a DC current path, comprising:

detecting an interrupt scenario for the DC current path including at least one first switching element, effecting an open state of the at least one first switching element; and connecting a resonance circuit in parallel to the at least one first switching element in response to an electric arc voltage at the first switching element being of sufficient magnitude for generating a counter-current in the resonance circuit greater or equal to an electric arc current in the DC current path upon activating the switch, wherein the first switching element comprises a circuit breaker with a negative slope in at least a portion of its electric arc voltage over electric arc current characteristic.

36. The method according to claim 35, comprising:

monitoring at least one of a current in a DC grid including the DC current path and a voltage across an inductance arranged in the DC grid for detecting the interrupt scenario.

37. The method according to claim 35, wherein the capacitance is in an uncharged state prior to connecting the resonance circuit in parallel to the series connection of the at least first switching element.

38. The method according to claim 35, wherein the resonance circuit is connected in parallel to the switching element after the open state of the at least first switching element is effected.

39. The method according to claim 35, wherein the counter-current reaches a level exceeding or equal to the electric arc current within a first rise in the counter-current signal.

40. The method according to claim 35, wherein the counter-current is an oscillating counter-current reaching a level exceeding or equal to the electric arc current only after some oscillations.

* * * * *